United States Patent [19]

Jackson

[11] 4,067,412

[45] Jan. 10, 1978

[54] FLOATING LADDER

[76] Inventor: Earle B. Jackson, 2525 Mercedes Drive, Fort Lauderdale, Fla. 33316

[21] Appl. No.: 754,014

[22] Filed: Dec. 23, 1976

[51] Int. Cl.[2] ..... E06C 9/06

[52] U.S. Cl. ..... 182/93; 182/85; 182/115; 182/129

[58] Field of Search ..... 182/1, 93, 85, 99, 82, 182/129, 97, 115

[56] References Cited

U.S. PATENT DOCUMENTS

| | | | |
|---|---|---|---|
| 1,736,825 | 11/1929 | Griffin | 182/129 |
| 2,528,074 | 10/1950 | Patton | 182/99 |
| 2,860,822 | 11/1958 | Smith | 182/93 |
| 3,774,720 | 11/1973 | Hovey | 182/97 |
| 3,970,169 | 7/1976 | Gonzalez | 182/1 |

*Primary Examiner*—Reinaldo P. Machado
*Attorney, Agent, or Firm*—Malin & Haley

[57] ABSTRACT

A rigid guide assembly having two inwardly disposed facing channel members secured to the stringer of a stationary platform and one end of a support member attached at each outward side of the top portion of the channel member. The other end of each support member is secured to the decking of the stationary platform. A vertical ladder secured to a floating base is disposed between the flanges of the two channel members thereby restricting the lateral movement of the ladder and float while allowing vertical movement as the water level changes.

5 Claims, 4 Drawing Figures

FLOATING LADDER

BACKGROUND OF THE INVENTION

In the past, many ladders have provided boaters with means for climbing from a boat onto a stationary pier. Said ladders have been rigidly secured to said pier and therefore are partially submerged in the water as the tidal water level changes. The lower part of the ladder is subject to marine growth which necessitated periodic maintenance on such ladders. Various types of expensive gang planks and moving ladder devices have been designed to connect between the boat and a dock.

BRIEF SUMMARY OF THE INVENTION

A new and improved floating ladder includes a guide assembly permanently secured to a pier or dock having two inwardly disposed facing channel members secured to the stringer of the dock and two upper support members secured to the deck of the dock, and a vertically movable ladder disposed between the flanges of the channel members. The movable ladder is connected to the top side of the floating base. As the water level changes the ladder will move in a vertical direction along with the floating base but is restrained from moving in the horizontal direction by the channel members. The floating base keeps the ladder and deck of the floating base clear of marine growth.

It is an object of this invention to provide a non-complex combination ladder for moving from a boat or from the water to the deck of a dock.

It is another object of this invention to provide a dock ladder that moves relative to the changing surface level of tidal water.

It is another object of this invention to provide a ladder that will remain out of water at all times thereby preventing marine lifeforms from growing on said ladder.

A further object of this invention is to provide a ladder float that has an underwater portion that remains relatively constant in relation to the surface of the water.

In accordance with these other objects which will be apparent hereinafter, the instant invention will now be described with particular reference to the accompanying drawings.

BRIEF DESCRIPTION OF THE DRAWINGS

The present invention is herein described and illustrated with respect to particular preferred embodiment thereof, as illustrated in the accompanying drawings.

DESCRIPTION OF THE PREFERRED EMBODIMENT

Figure 1:
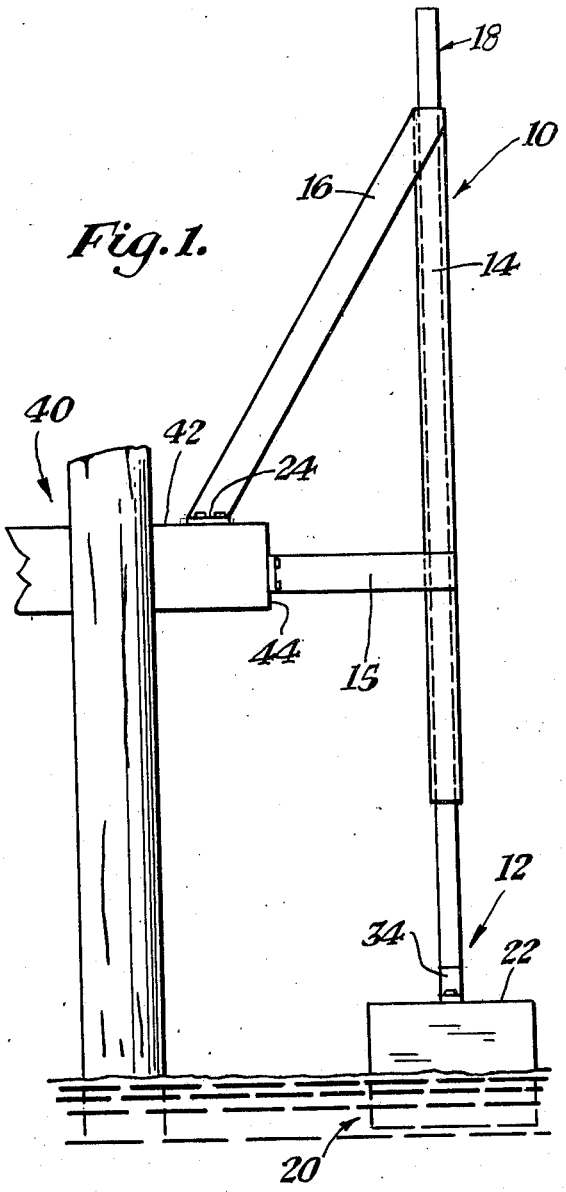
FIG. 1 is a side elevational view of the floating ladder attached to the end of a pier.
Figure 2:
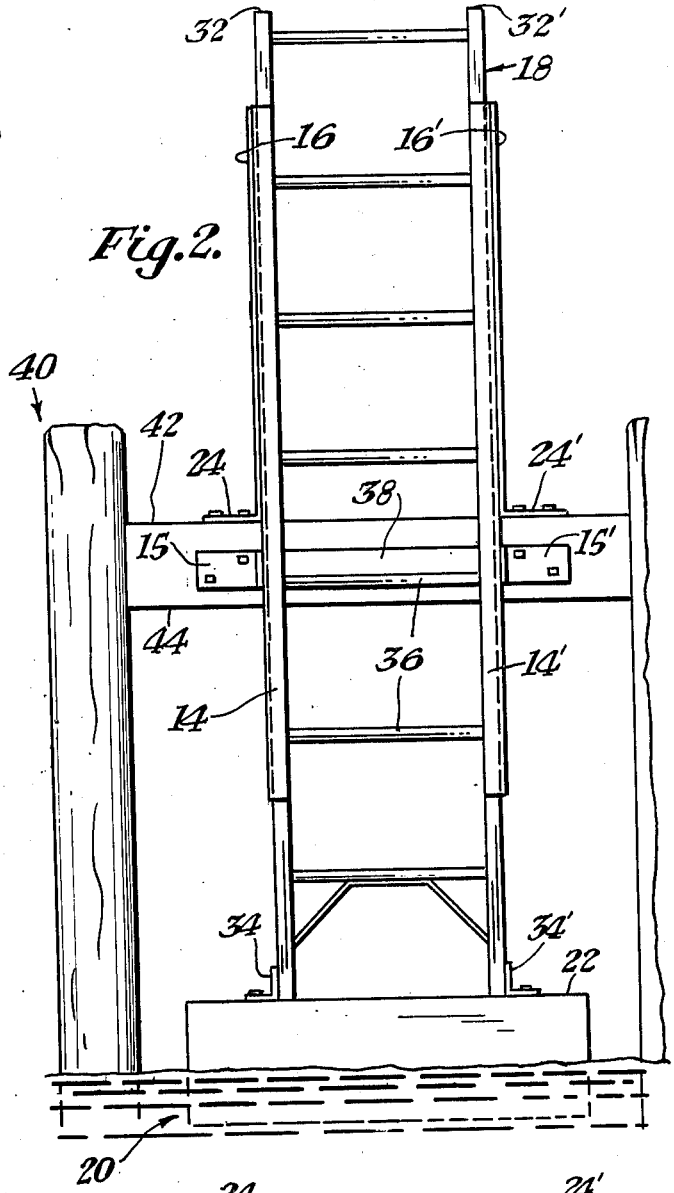
FIG. 2 is a front elevational view of the floating ladder attached to the end of a pier.
Figure 3:
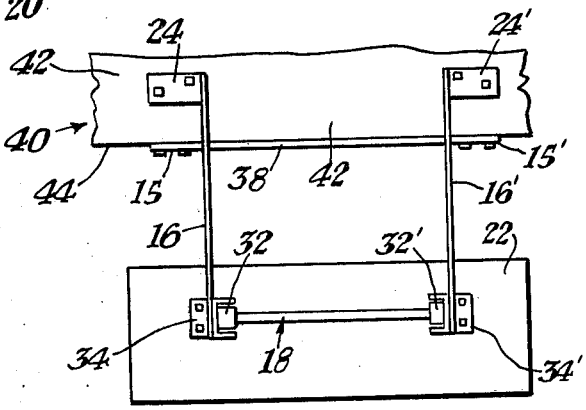
FIG. 3 is a top plan view of the floating ladder attached to the end of a pier.

Considering now the present invention in some detail and referring to the drawings, it is noted that in FIGS. 1, 2 and 3 there is illustrated an embodiment of the present invention consisting of a guide assembly 10 including two inwardly disposed channel members 14, 14' having the upper end portion connected to two support members 16, 16', respectively. The other end of the support members 16 and 16' are secured to the deck of the pier. Channel members 14, 14' are connected to stringer 44 by leg members 15 and 15' and bearing plate 44. The floating ladder assembly 12 consisting of a step ladder 18 attached to the top surface 22 of a floating structure 20. The sides of 32, 32' of step ladder move in the guide assembly 10 in a vertical direction as the float adjusts to tidal waters and the weight on the ladder.

Figure 4:
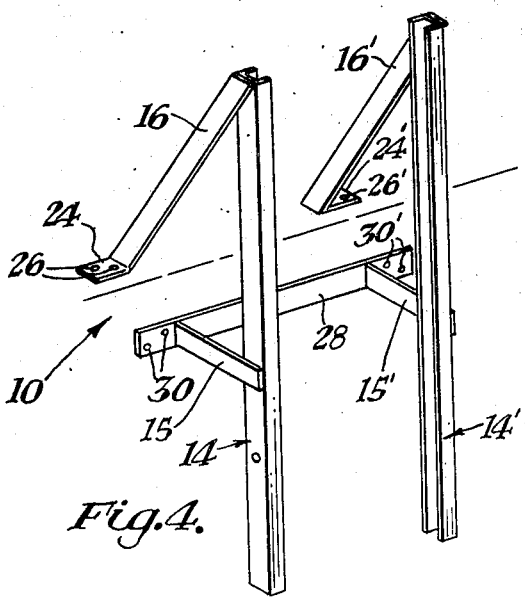
FIG. 4 is a perspective view of the guide assembly.

FIG. 4 shows the construction of the guide assembly 10. As illustrated, said guide assembly 10 has two vertical, inwardly facing channel members 14, 14' having an inside horizontal separation slightly larger than the outside horizontal separation of the side rails 32, 32' of the ladder 18, shown in FIGS. 1, 2 and 3, to permit vertical movement of said ladder 18 within said channel members 14, 14'. Two support members 16, 16' are secured generally to the outside top of said channel members 14, 14' by welding or other means and extend at an angle from said channel members 14, 14' but in the same general plane of said channel members 14, 14', respectively. Short generally horizontal foot supports 24, 24' are secured, also by welding or other means, to the other ends of the support members 16, 16' opposite the ends secured to said channel members 14, 14'. Said foot supports 24, 24' have vertical bolt holes 26, 26' through them. A bearing plate assembly 28, as shown in FIG. 4, is secured to legs 15 and 15' connected to the outside of said channel members 14, 14', again by welding or other means, at some distance below the plane of said foot supports 24, 24'. Said bearing plate assembly 28 and legs 15 and 15' are secured to the outside of said channel members 14, 14' and run rearward whereupon said short legs 15, 15' are secured to a bearing plate 38. The bearing plate 38 is in a vertical plane and extends in a general horizontal direction beyond the outside dimensions of said channel members 16, 16'. The bearing plate 38 has a plurality of horizontal bolt holes 30, 30' through it. The guide assembly 10 described hereinabove is thus secured by bolts or other means to the decking 42 and a stringer 44 of a pier 40 by the foot supports 24, 24' and the bearing plate 38 respectively, as shown in FIGS. 1, 2 and 3.

FIGS. 1, 2 and 3 show the construction of the floating ladder assembly 12. As illustrated said floating ladder assembly 12 has a vertical step ladder 18 fastened to the top 22 of a floating structure 20 by means of brackets 34, 34'. The ladder 18 consists of a plurality of rungs 36 disposed between two vertical side rails 32, 32' in a conventional manner. Said side rails 32, 32' are sized such that said ladder 18 is enclosed by the generally U-shaped of said channel members 14, 14', but is free to move in the vertical direction. The floating structure 20 is generally rectangular bouyant box like pontoon, which can be made from marine plywood or similar material with a flat deck 22 to which the vertical ladder 18 is rigidly fastened by means of a plurality of brackets 34, 34'. Said floating structure 20 with ladder 18 attached and disposed between said channel members 14, 14' as illustrated in FIGS. 1, 2 and 3 is sufficiently bouyant to prevent the floating ladder assembly 12 from sinking to any great extent when a person of normal weight steps on said ladder 18.

This device allows the ladder to stay free of marine growth. Also, the ladder float is easily serviced by raising surface 22 to the base of channel members 14, 14' in order to raise the bottom of the float out of the water. A lock means such as a pin may be passed through a channel member 14, 14' and side rails 32, 32'.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A floating ladder for use with a member of a stationary platform comprising:

a rigid guide assembly removably connectable to the stationary platform, said guide assembly including support means and guide means;

said support means attached to said guide means and removably connectable to the member of the stationary platform;

a generally vertical ladder secured to a floating base, said generally vertical ladder movably connected to said guide means whereby said generally vertical ladder and said floating base are restricted in lateral movement while allowing said generally vertical ladder to move up and down as said floating base moves with water level changes.

2. A floating ladder as set forth in claim 1, wherein;

said guide means includes two inwardly disposed generally vertical members.

3. A floating ladder as set forth in claim 2 wherein;

said generally vertical ladder includes side rails and intermediate steps;

said generally vertical guide means are inwardly disposed facing channel members with flange portion partially surrounding said side rails to guide said generally vertical ladder's vertical movement.

4. A floating ladder as set forth in claim 3 wherein;

said support means positioned between said generally vertical guide means members and a deck connecting plate, said deck connecting plate removably connectable to a member of a stationary platform.

5. A floating ladder as set forth in claim 3 wherein:

said rigid guide assembly connected to a stationary platform;

the bottom of said vertical members positioned above the water level to allow said ladder and floating base to be raised vertically out of the water for maintenance.

* * * * *